US007497402B2

(12) United States Patent
Hobbis et al.

(10) Patent No.: US 7,497,402 B2
(45) Date of Patent: Mar. 3, 2009

(54) STORAGE AND TRANSPORTATION OF ALUMINIUM STRIP

(75) Inventors: Andrew Hobbis, Banbury (GB); David Skingley Wright, Rosdorf-Dramfeld (DE)

(73) Assignee: Alcan International Limited, Quebec (CA)

( * ) Notice: Subject to any disclaimer, the term of this patent is extended or adjusted under 35 U.S.C. 154(b) by 0 days.

(21) Appl. No.: 10/433,499

(22) PCT Filed: Dec. 4, 2001

(86) PCT No.: PCT/GB01/05351

§ 371 (c)(1),
(2), (4) Date: Aug. 28, 2003

(87) PCT Pub. No.: WO02/45876

PCT Pub. Date: Jun. 13, 2002

(65) Prior Publication Data

US 2004/0061019 A1 Apr. 1, 2004

(30) Foreign Application Priority Data

Dec. 4, 2000 (EP) ..... 00310770

(51) Int. Cl.
*B65H 75/08* (2006.01)

(52) U.S. Cl. ..... 242/613.1; 242/530.2; 242/160.4; 242/571; 242/609

(58) Field of Classification Search ..... 242/613.1, 242/530.2, 160.4, 571, 412, 410, 413, 413.2, 242/609, 609.1; 72/148
See application file for complete search history.

(56) References Cited

U.S. PATENT DOCUMENTS

| | | | | |
|---|---|---|---|---|
| 4,508,284 | A * | 4/1985 | Kataoka | 242/413.1 |
| 2002/0117573 | A1 * | 8/2002 | Nakata et al. | 242/412 |

FOREIGN PATENT DOCUMENTS

| | | |
|---|---|---|
| JP | 55088929 | 7/1980 |
| JP | 61126927 | 6/1986 |
| JP | 08071644 | 3/1996 |
| JP | 08132136 | 5/1996 |
| JP | 09057344 | 3/1997 |
| JP | 09076012 | 3/1997 |
| JP | 09122752 | 5/1997 |
| JP | 10128445 | 5/1998 |
| JP | 11179422 | 7/1999 |

* cited by examiner

*Primary Examiner*—Sang Kim
(74) *Attorney, Agent, or Firm*—Robert D. Katz; Cooper & Dunham LLP

(57) ABSTRACT

The invention is particularly directed to the problem of creep deformation in a coiled aluminum strip, which occurs during coiling and for a period thereafter. The problem arises because the profile of the strip across its width is not flat, and is in fact usually thicker in the middle than at the edges (positive crown). To compensate for this, the invention provides that the spool onto which the coil is wound is adapted to provide more support to the strip in the center than at the edges, by making the central portion of the spool of a greater diameter than the end portions of the spool. A strip having a positive crown which is wound onto such a spool was found to exhibit significantly reduced creep strain, leading to reduced creep deformation.

19 Claims, 12 Drawing Sheets

Fig.11.

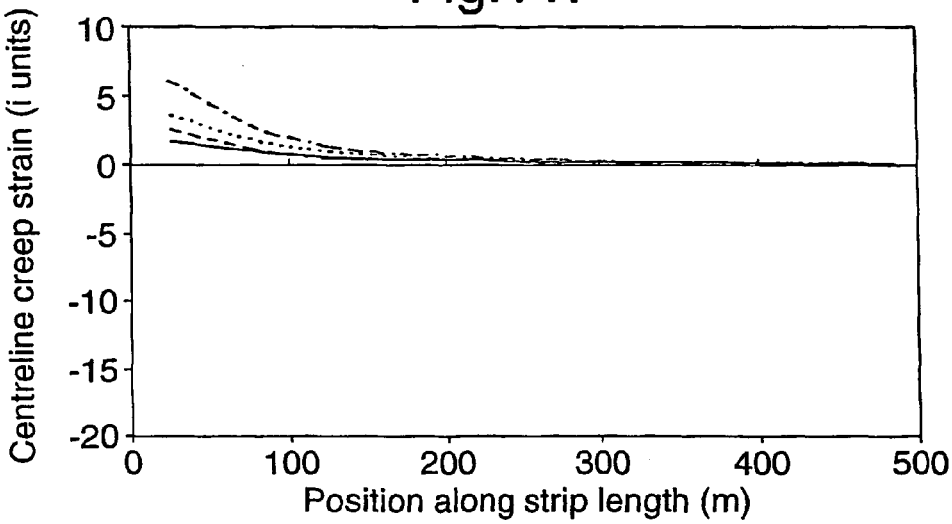

-·-·-15 MPa initial coiling tension & spool with centre
·····15 MPa initial coiling tension & spool with centre
---- Conventional coiling practice & spool with centre sleeve
—— Conventional coiling practice & plain spool

Fig.12.

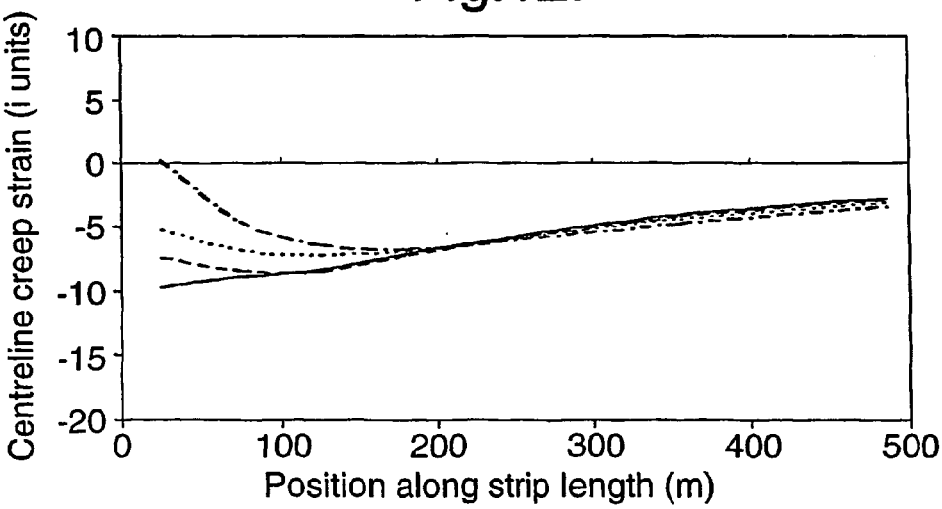

-·-·-15 MPa initial coiling tension & spool with centre
·····15 MPa initial coiling tension & spool with centre
---- Conventional coiling practice & spool with centre sleeve
—— Conventional coiling practice & plain spool

STORAGE AND TRANSPORTATION OF ALUMINIUM STRIP

FIELD OF THE INVENTION

Background Of The Invention

The present invention relates to a spool suitable for use in the storage and transportation of strip material made of aluminium or an alloy thereof, and to a method of coiling such material on a spool.

SUMMARY OF THE INVENTION

Aluminium strip material, such as that used in lithographic printing, is coiled under tension on large steel or fibre spools for storage and transportation. The spool is a large cylinder that has a uniform outer diameter and a length sufficient to completely support the width of the strip material, often in practice extending beyond the strip for a short distance either side. It is known that the coiling of aluminium strip material can affect the flatness of the strip. Aluminium strip material that was flat immediately before it was coiled onto a spool can become off-flat as the strip creeps under the uneven stresses that arise across the width of the strip. Aluminium presents a particular problem in coiling because it is much more prone to creep than, for example, steel.

The non-uniform stresses across the width of the strip when it is coiled arise from the fact that the thickness of the strip varies slightly across the width of the strip, with the strip usually being slightly thicker in the middle than at the edges (a positive crown). This variation in thickness results in the coil being slightly barrel-shaped, i.e. the coil has a larger diameter at its middle than at its edges. This further results in the middle of the coil carrying more of the coiling tension than the edges.

The manufacturing process for aluminium strip generally tries to ensure that the strip does have a positive crown since strip with a negative crown (implying that the outer edges are thicker than the centre) can result in unpredictable handling, particularly during later fabrication processes. Because the manufacturing process is a multi-step process, a margin of error needs to be built in to ensure that no part of the output has a negative crown. Thus the manufacturing process is set to deliberately provide a crown, typically such that the thickness in the central section is at least about 0.3% higher than that at the two opposing edge sections. Bearing the margin of error in mind, this generally ensures that, at no point in the strip, is the crown such that the central section is less than about 0.1% greater in thickness than the opposing edge sections. Typically however the manufacturing process is set so that the crown is such that the central section is approximately 0.5% greater in thickness than the opposing edge sections, but up to 1% or even higher is possible, with 2% the practicable maximum.

Creep occurs during coiling, when it may be made easier by the slight warming of the aluminium that often occurs during cold rolling or during pre-treatment processes such as cleaning or during stoving after painting. Creep continues in the coil even at room temperature, until the stress is relaxed to the extent that the creep rate becomes insignificant.

As each lap of the aluminium strip is coiled under tension about the spool, each new lap imposes an incremental inward pressure on the material that has already been coiled onto the spool. This results in the flatness of the strip varying with respect to its position in the coil. For example, the strip from the outer laps of the coil (otherwise referred to as wraps) can buckle along the centre line of the strip whilst strip from the inner wraps can buckle along its edges. The former deviation from flatness is termed 'long-middle' whereas the latter deviation from flatness is termed 'wavy edges'.

When the aluminium strip is being coiled onto the spool, the spool is mounted on a mandrel which rotates the spool during the coiling procedure. Once the coiling of the strip has been completed, the spool is removed from the mandrel. Unfortunately, especially with fibre spools, the spool can deform under the pressure from the coiled strip which can further exacerbate the problems mentioned above with respect to off-flatness. The compressive force from the coil causes the spool to radially displace inwards which makes the inner laps shorter and so causes the tension in the inner laps to be reversed. FIG. 1 is a model prediction of creep strain (in i units) for a coil on a conventional spool 24 hours after coiling. The compressive (−ve) strain for the inner laps at the middle of the strip can be clearly seen along with a large positive strain either side of the middle region of the strip. This model thus predicts the strip at the inner laps to have wavy edges with quarter pockets. Quarter pockets are formed by the buckling of the strip along parallel longitudinal lines inboard from each of the longitudinal edges of the strip approximately a distance equal to a quarter of the total width of the strip.

Schnell et al (Metallwissenschaftund Technik vol. 8 August 1986) have described the problem of off flatness and attempted to explain these effects but have not proposed any solution.

Attempts have been made to reduce the off-flatness caused by coiling but these attempts have generally focused on post processing of the strip to straighten the strip. However, in JP11-179422 a method is described for controlling the flatness of steel strip material that has a convex crown which utilises a contoured spool having a concave crown.

JP 09-057344 and JP 09-076012 both describe similar methods of winding steel strip material onto a mandrel. In both cases a narrow sleeve defining a convex crown is fitted on the mandrel and is positioned centrally of the width of the steel strip being coiled.

The present invention seeks to provide a system and a method of coiling aluminium strip on a spool in such a way as to reduce the deformation of the strip resulting from creep, and thereby improve the flatness of the strip. The present invention is particularly concerned with reducing the wavy-edge off-flatness in the inner laps of a coil of aluminium strip material.

As already mentioned, a conventional cylindrical spool defines an outer supporting surface for the strip material which is cylindrical in shape. If the strip material were of a constant thickness across its width, then the spool would provide a substantially constant support across the width of the strip material and the uneven stresses which cause creep would not arise. However, where the strip has a positive crown, the conventional spool gives a greater support to the strip at its middle than at its edges, the exact profile of this variation depending on the shape of the profile across the strip. The aforementioned JP11-179422 seeks to cater for this by providing that the external shape of the spool inversely matches the external shape of the strip across its width, the purpose being to try to negate the uneven stresses caused by the variation in the thickness of the strip across its width, to thus emulate the situation which would occur if the strip had a constant thickness across its width; hence, for a strip having a positive crown the external shape of the spool is concave, and vice-versa.

In a first aspect of the invention there is provided a system for coiling of aluminium strip material, said system consisting of a coil assembly comprising a mandrel, a spool removably mounted on said mandrel and an aluminium strip material having a positive crown, said coil assembly having a supporting surface on which is to be coiled said strip material, and wherein the coil assembly is adapted so that its supporting surface provides a support profile in which the support provided by that part of the supporting surface which supports the crown is greater than that provided by the remaining part or parts of the supporting surface during coiling of at least the inner laps of the strip material.

The normal natural consequence of the rolling process by which the strip material is made is that the crown is positioned approximately centrally with respect to the width of the strip material; however, subsequent processing, for example the slitting of a wider strip to form narrower ones, may result in the crown being off-centre when it is coiled. The teaching of the present invention can be applied whatever the position of the crown, but it will be assumed herein that the crown is approximately centrally positioned with respect to the strip material, in which case, the support provided to the central portion of the strip material will be greater than that provided to opposing edge portions of the strip material during coiling of at least the inner laps of the strip material.

The support profile of the supporting surface may be provided by adaption of the shape and/or properties of the spool, or by adaption of the strip material to be wound thereon, or a combination of both.

Adaption of the coil assembly to enable its supporting surface to provide the required support profile may be achieved in a number of ways. For example, the spool may be contoured to define a supporting surface which has a diameter at a central region which is greater than at its end regions. Thus, during coiling of the strip material, a larger tensile stress is applied to the central region of the strip than to its end regions, particularly in the inner laps of the coil.

The interface between the greater diameter in the central region and the lesser diameter at the end regions may be by way of one or more steps, or may be a smooth transition, or a combination of both, according to the circumstances. Thus the contour of the supporting surface may vary from a smooth convex surface, extending across the expected width of the strip material to be coiled, to a stepped cylindrical surface in which the central region has a greater diameter than the end regions, the central region having a width less than the width of the strip material to be coiled.

The use of a spool having such a convex supporting surface acts to alter the distribution of stress in the inner laps of the coiled strip, thereby reducing subsequent creep strain. Using the contoured spool of the present invention, the concentration of coiling tension in the middle of the strip width arises at the start of coiling. This reduces the amount of strip that must be discarded from the inner laps of a coil where strict flatness requirements apply. In contrast, on a normal plain cylindrical spool, the concentration of coiling tension arises only after some laps have been coiled. Hence, the present invention is of particular benefit when used with aluminium strip materials for which there are strict flatness requirements such as materials used in lithographic printing.

The required support profile may be achieved by altering the external physical profile of the spool itself, or by adding profiling elements to an otherwise plain cylindrical spool, or a combination of both techniques may be used. Thus, for example, a profiling element in the form of a sleeve may be fitted over the central region of a plain cylindrical spool to increase the effective diameter of the supporting surface of the spool in its central region. Such a sleeve will have a length which is less than the width of the strip material to be coiled. This arrangement has the advantage that a plain cylindrical spool can be used; such spools can be manufactured very cheaply by simply cutting off suitable lengths from an elongate tube. Anything more complicated, such as a profiled tube, is likely to have to be manufactured as an individual item and is thus much more costly. In the industry, spools are regarded as throw-away items and therefore cost is an important factor.

Another way of utilising a plain cylindrical spool is to realise the aforementioned profiling element as the leading end of the strip material itself, for example by providing that the strip is formed, at its leading end, with a tongue which is narrower in width than the remainder of the strip The tongue has a length, in the longitudinal direction of the strip, which is approximately equal to the circumference of the outer surface of the spool. Thus, as coiling commences, the first lap is formed by the narrow tongue which thus effectively forms a profiling element as described above. The thickness of the tongue, and hence the profiling element so formed, is conveniently equal to the thickness of the strip material; if a thickness greater than this is required, then the length of the tongue can be increased to provide two or even more turns, before the full width of the strip commences. Preferably the length of the tongue is equal to n times the outer circumference of the spool, where n is an integer.

In an embodiment, the width of the tongue increases from a smaller width to the full width of the strip material during the first few laps of the strip material about the coil assembly.

Another way of adapting the aluminium strip material to provide the required support profile is an arrangement in which a sheet of, for example, aluminium, is attached, for example by adhesive, mechanical fixing, welding, or spot welding to a surface of the leading end of the strip material, said sheet having a width narrower than that of the strip material, and being centrally located with respect to the width of the strip material, said sheet of material being effective, as the strip material is coiled, to provide the spool with an effective outer diameter at a central region of the spool that is greater than the effective outer diameter of the spool at opposing end regions of the spool. Preferably said sheet of material has a length, in the longitudinal direction of the strip material, which is approximately equal to n times the outer circumference of the spool, where n is an integer.

An alternative way of adapting the spool to provide the required support profile is to alter the support strength provided by the spool along the length of its supporting surface. When the strip is coiled onto the spool, compressive forces act radially inwards on the spool, thus causing compression of the spool material. Conventionally, the spool is constructed with a constant cross section in the direction of its axis, at least along that part of its length which defines the supporting surface. This ensures that any distortion of the spool caused by these compressive forces is substantially constant across the width of the strip material being coiled. If, however, the cross section is not constant along the axis then the effect of the compressive forces will be different across the length of the supporting surface. This translates into a different effective support for the strip material being coiled according to its position across the width. Thus, for example, if the cross section of the centre region of the spool is greater than at the end regions, then the required support profile can be achieved even if the supporting surface itself has a conventional plain cylindrical shape. A similar effect can be achieved by weakening the support which the material of the spool is capable of providing in certain select regions by removing material to reduce its strength without necessarily changing the shape of the supporting surface itself. For example, the support which the end regions of the supporting surface provides can be reduced with respect to that provided by the central region by cutting slits into the material of the spool to form fingers at the ends, which partially collapse (i.e. move inwards) when the coil is wound onto the spool.

A further way of adapting the spool so that its supporting surface exhibits the required support profile is to vary the stiffness or rigidity of the material of the spool along its length, for example by forming the central region of a material having a greater stiffness or rigidity than the material of the opposing end regions. This can be changed by altering the inherent stiffness or rigidity of the material itself, or by locally weakening the material by forming apertures or slits, somewhat in the manner discussed above.

It has already been mentioned that, in conventional practice, the spool is mounted on a mandrel, the mandrel being caused to rotate the spool during coiling. It is possible to use the mandrel to adapt an otherwise conventional spool to cause its supporting surface to provide a support profile which varies along its length in the manner described above. Thus, for example, the mandrel may be such as to deform the spool when in place on the mandrel such that the diameter of the supporting surface of the spool in the central region is greater than that at the opposing end regions. In such a case, the mandrel would normally be of the expanding type, whereby it could be collapsed for removal after coiling is completed.

A combination of these various techniques can be used to achieve the desired support profile.

In an embodiment, the spool is adapted such that the support profile of its supporting surface matches, at least approximately, the shape of a graph representing the radial displacement of an outer lap of a strip material of the same type as that to be coiled, which strip material has been coiled on a conventional right cylindrical spool, after removal of the mandrel.

In a second aspect the present invention provides a method of coiling aluminium strip material having a positive crown wherein the strip material is fed to a coil assembly comprising a spool and a mandrel; the coil assembly is rotated thereby coiling the strip material about a supporting surface of the coil assembly; and thereafter the mandrel is removed, said method being characterised in that, during coiling of at least the inner laps of the coiled strip material, the coil assembly is adapted so that its supporting surface provides a support profile in which the support provided by that part of the supporting surface which supports the crown is greater than that provided by the remaining part or parts of the supporting surface.

In a further alternative, either alone or in combination with the above aspects of the invention, a tension force is applied to the aluminium strip as it is being coiled. Tension is not applied until the leading end of the strip has become firmly gripped to the spool, this usually being shortly after the turns begin to overlap at the completion of the first lap. Preferably the initial laps of the strip are coiled at a first higher tension and a second lower tension is applied to later laps of the strip as it is being coiled. Thus, most of the coil is coiled with the strip under a nominal tension, sufficient to hold the coiled coil in a stable state for storage and transportation. This second (nominal) tension is preferably at least 10% lower than the first, higher, tension and is more preferably at least 20% lower. In addition, the second tension is preferably no greater than 80% lower than the first tension and is more preferably no greater than 50% lower. The coiling tension may be continuously reduced from the higher tension to the lower tension and this reduction to the lower tension is preferably performed during the first half of the total laps of the coil. This is illustrated conceptually in FIG. 17 which shows a short level section (curve a) at a higher tension, followed by the remainder at a lower tension—the nominal tension. The transformation from the higher tension to the nominal tension may be relatively rapid, as shown by curve a, or may be slower, with or without a shorter section at the higher tension, as shown by curves b and c. The tension build-up associated with the first lap is not shown.

Reference herein to aluminium is to be understood as a reference to aluminium and its alloys.

Reference is also made herein to flatness and to off-flatness. In the context of this document off-flatness is to be understood to be the difference in strain across the width of the strip as measured at different positions along the longitudinal or coiling direction of the strip.

BRIEF DESCRIPTION OF THE DRAWINGS

Embodiments of the present invention will now be described by way of example with reference to and as shown in the accompanying drawings, in which.

Figure 3:
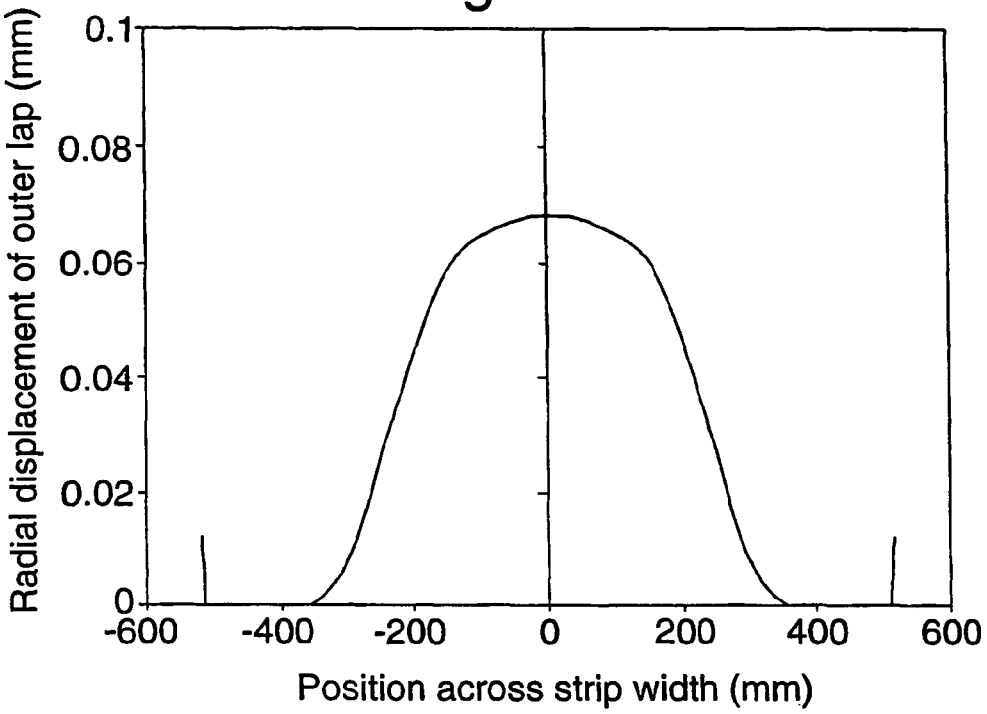
Figure 4:
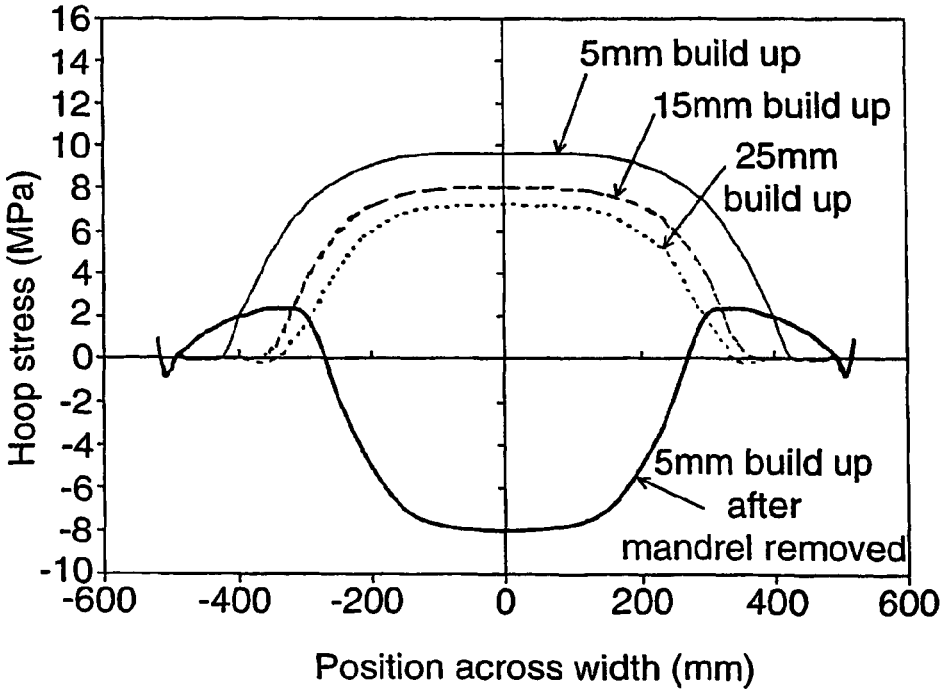
Figure 5:
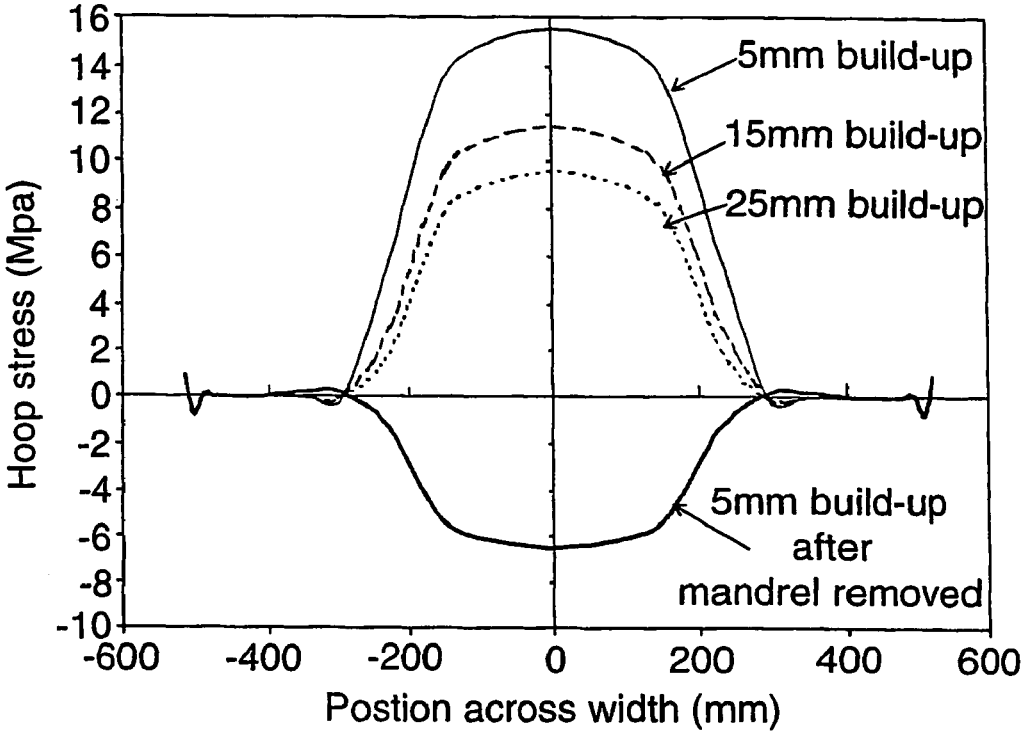
Figure 6:
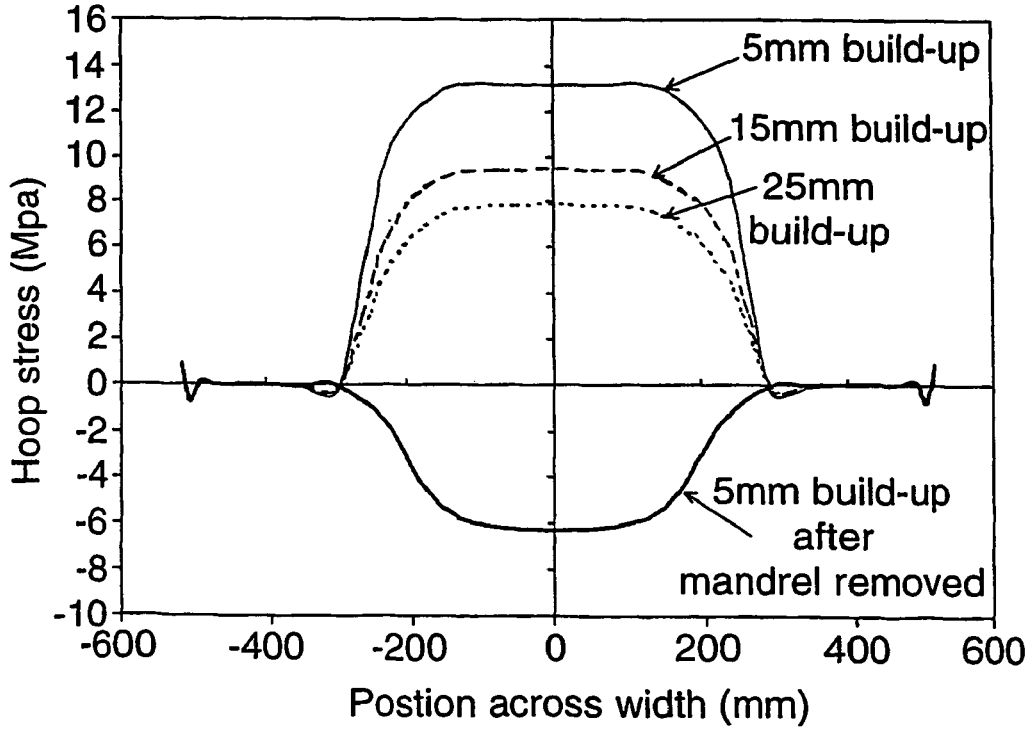
Figure 7C:
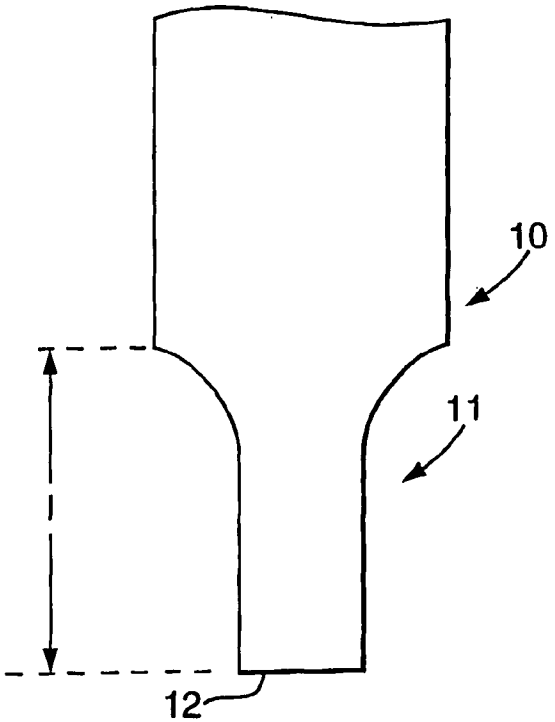
Figure 7B:
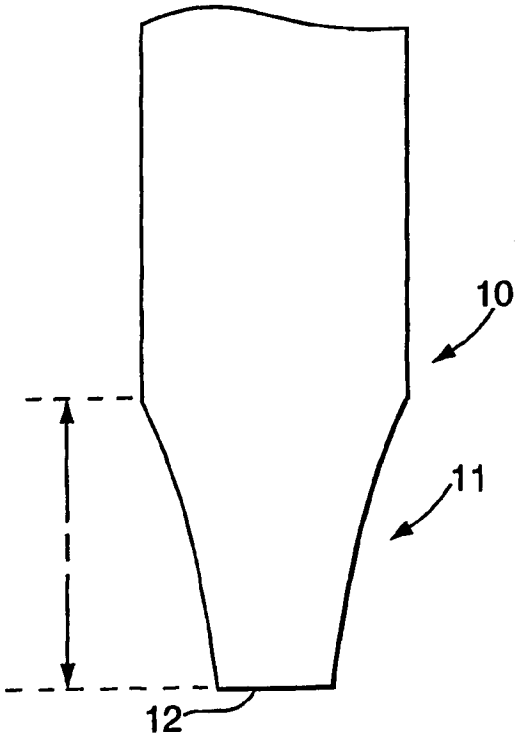
Figure 7A:
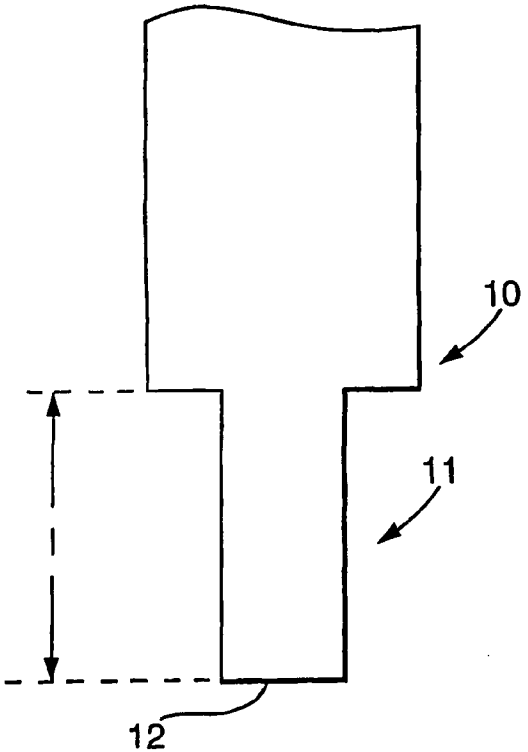
Figure 8:
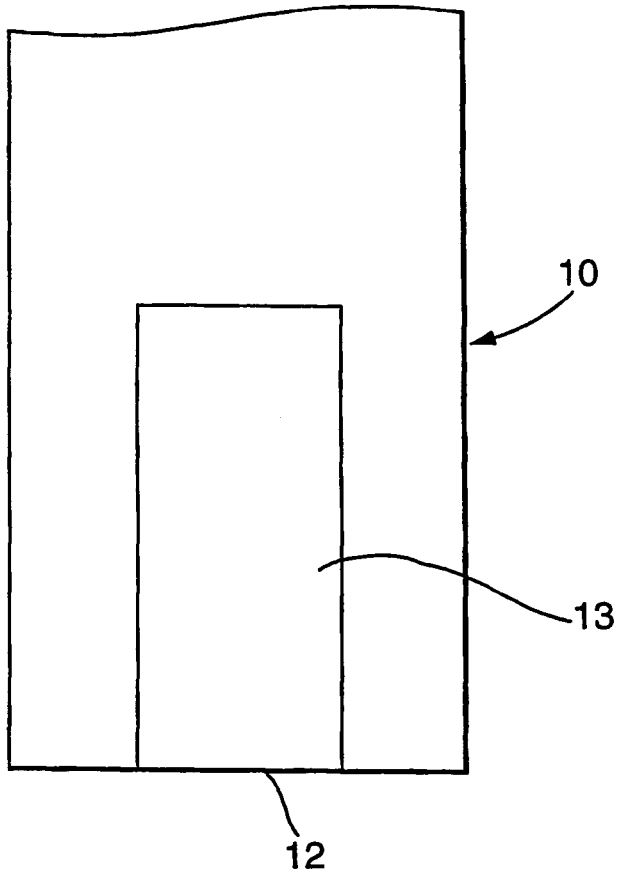

*Fig.* 2A is a schematic perspective of another embodiment of a spool in accordance with present invention;

FIG. 3 illustrates a model prediction of the radial displacement of the outer lap of an aluminium strip coiled on a conventional right cylindrical spool after removal of the mandrel;

FIG. 4 illustrates a model prediction of the distribution of hoop stress across the width of three different positions in a coil during coiling on a conventional spool, and after removal of the mandrel;

FIG. 5 illustrates a model prediction of the distribution of hoop stress across the width of the same three laps as for FIG. 4 during coiling on a spool, and after removal of the mandrel, in accordance with the present invention;

FIG. 6 illustrates a model prediction of the distribution of hoop stress across the width of the same three laps as for FIG. 4 during coiling on an alternative spool, and after removal of the mandrel, in accordance with the present invention;

FIG. 7A, B, C are diagrammatic plan views of the leading end of an aluminium strip to be coiled, showing shaped end sections;

FIG. 8 is a diagrammatic plan view of the leading end of an aluminium strip to be coiled, showing a modified end section.

Figure 17:
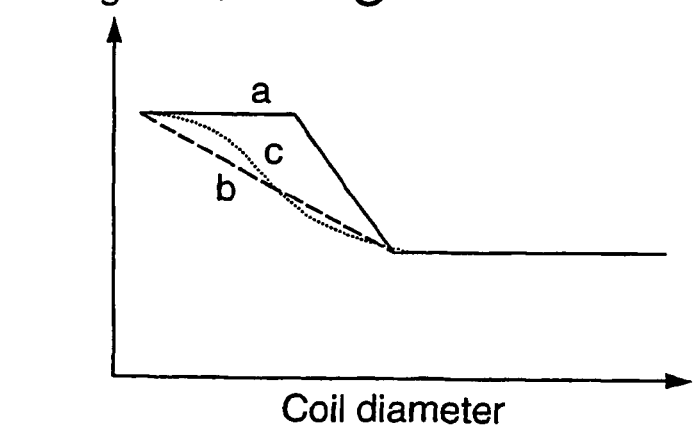
Figure 9:
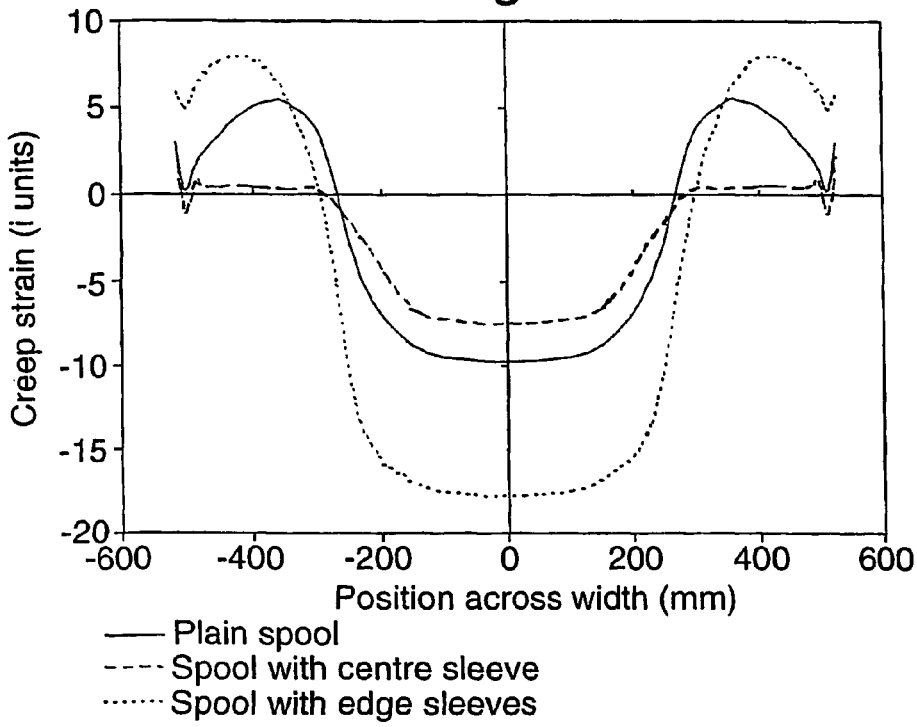
Figure 10:
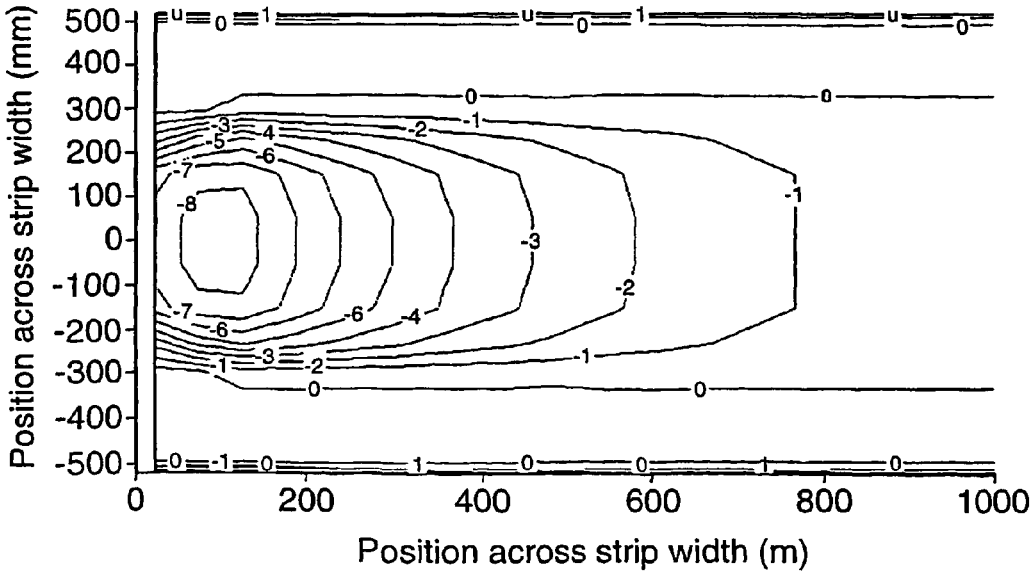
Figure 13:
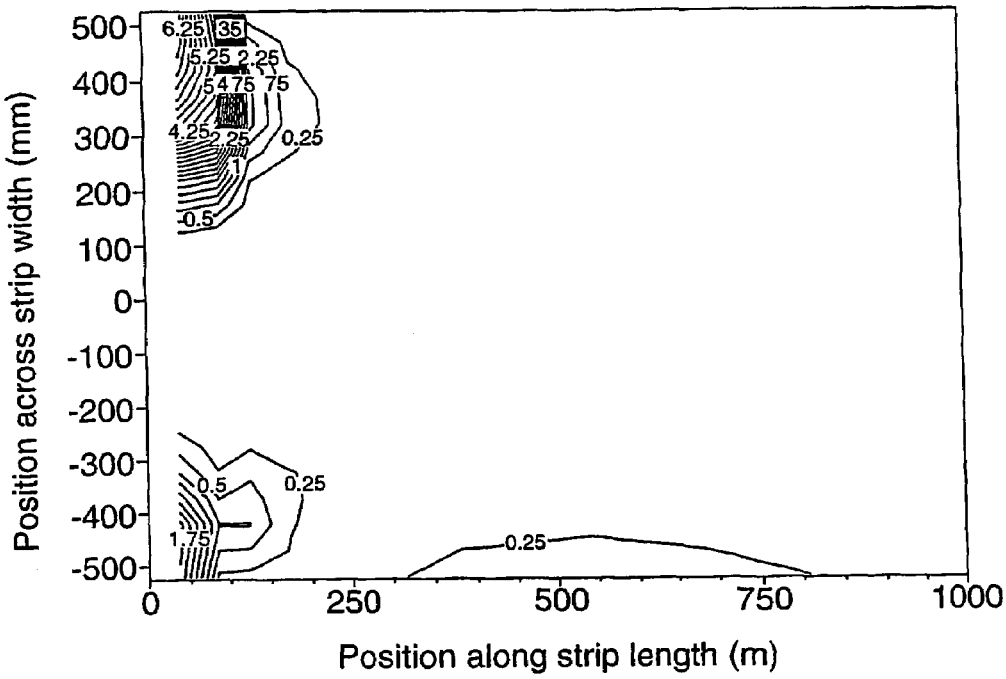
Figure 14:
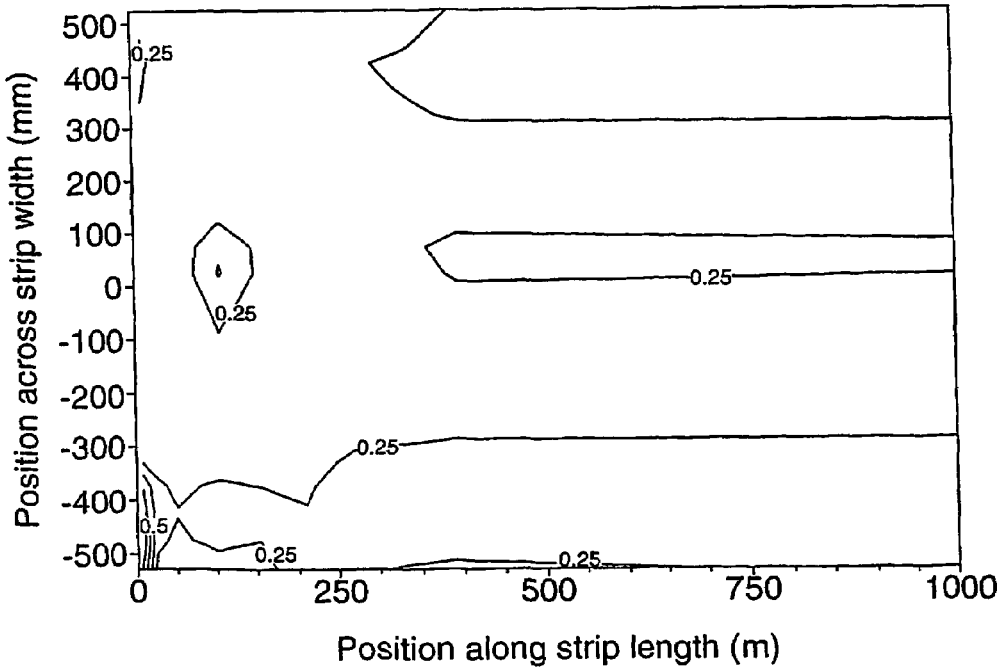
Figure 15:
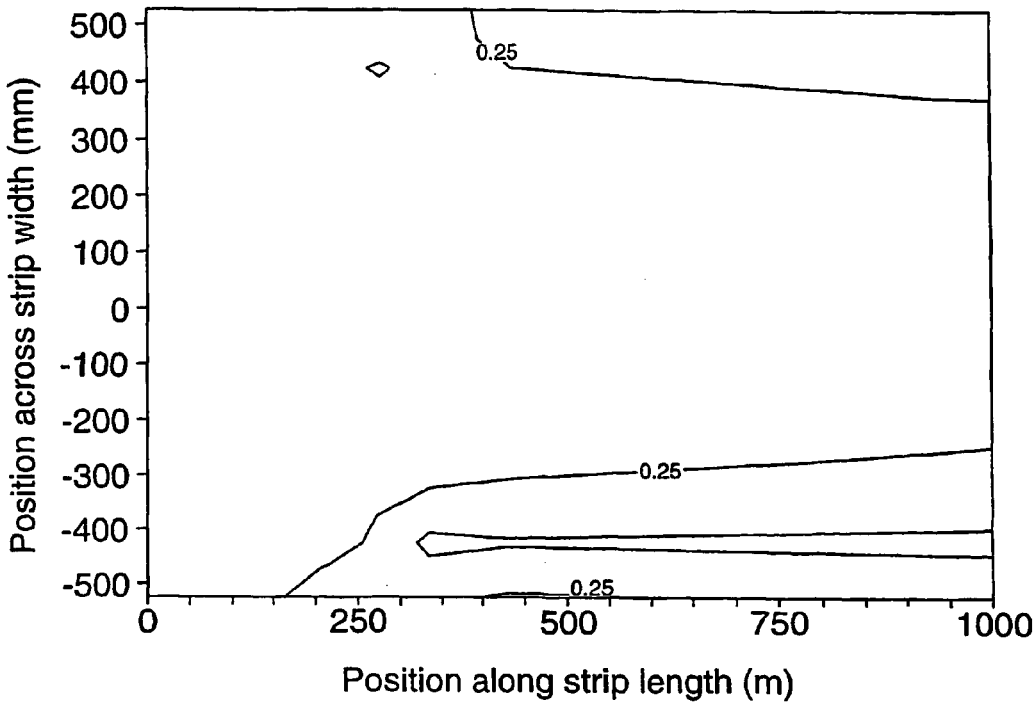
Figure 16:
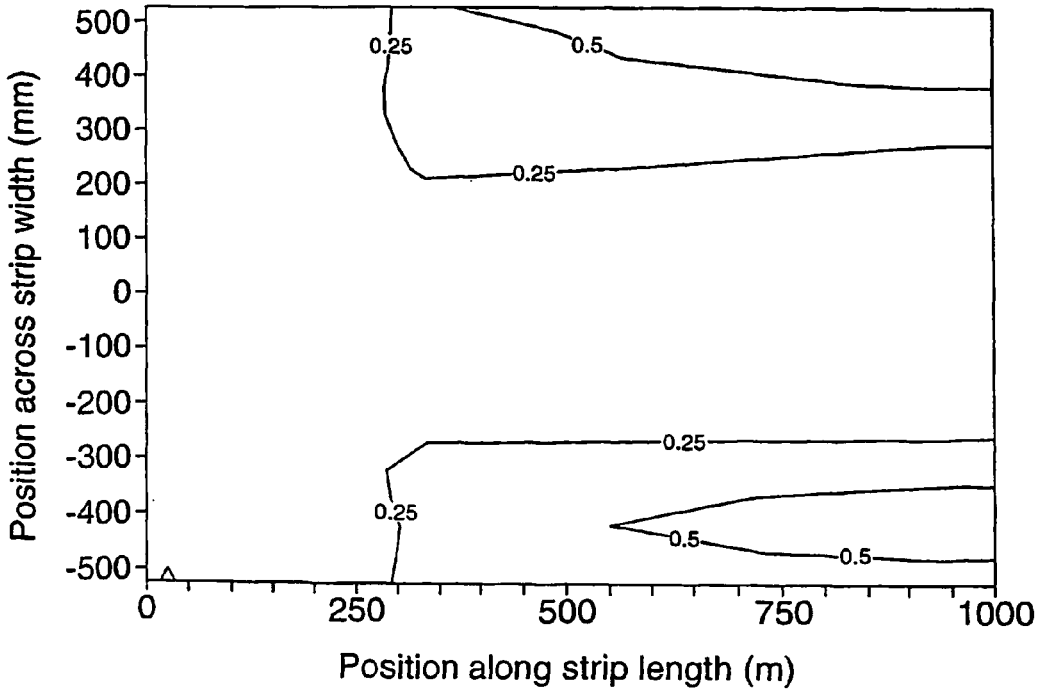
Figure 17A:
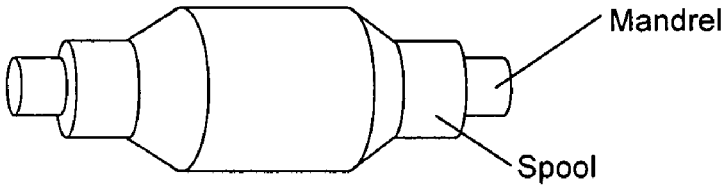
Figure 17B:
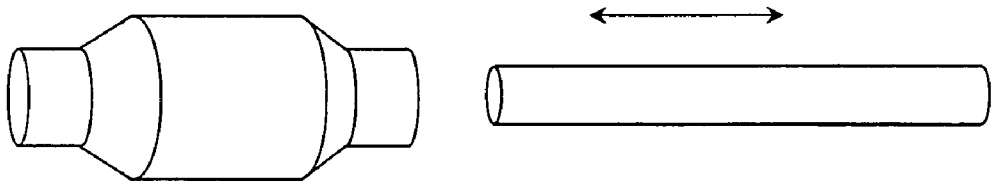
Figure 18:
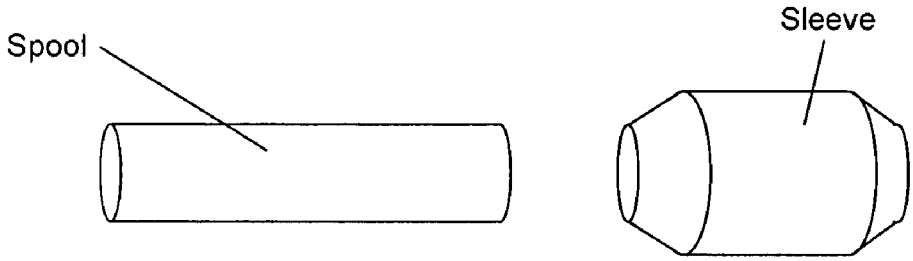
Figure 19:
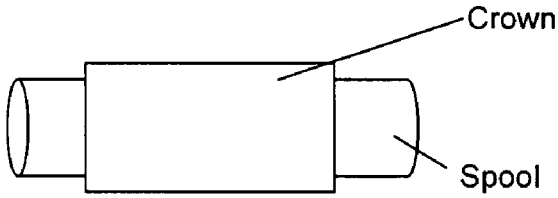
Figure 20:
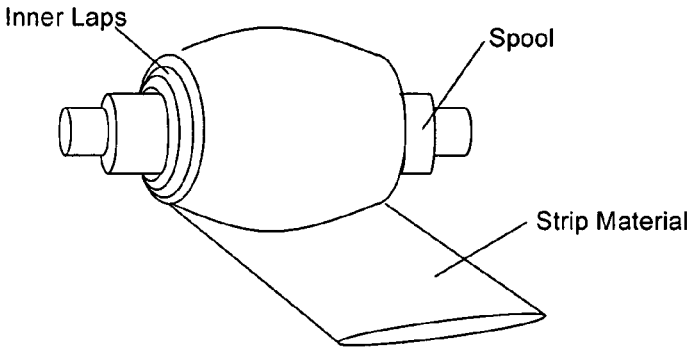
Figure 21:
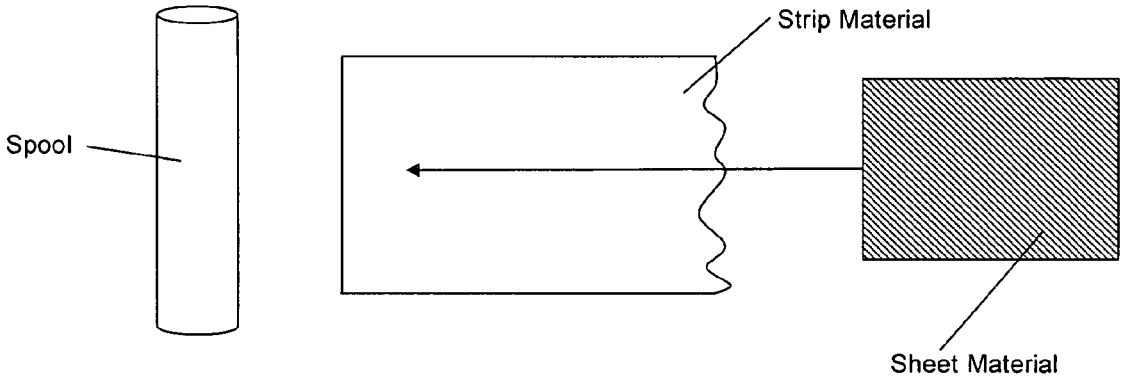
Figure 22:
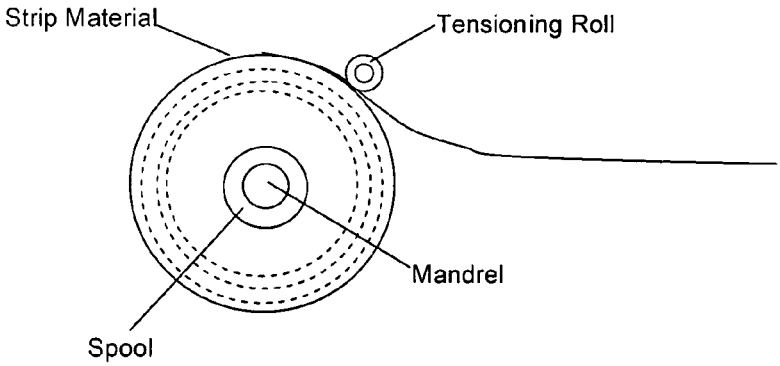

FIG. 9 illustrates a model prediction of the creep strain across the width of the first lap 5 mm radially from the spool immediately after coiling for a conventional spool and for a spool in accordance with the present invention and a spool similar to the prior art spool of JP11-179422;

FIG. 10 illustrates a model prediction of the creep strain for an aluminium strip coiled on a spool having a centre sleeve in accordance with the present invention, 24 hours after coiling;

FIG. 11 illustrates a model prediction of creep strain with respect to initial coiling tension and spool contour immediately after coiling;

FIG. 12 illustrates a model prediction of creep strain with respect to initial coiling tension and spool contour 24 hours after coiling;

FIGS. 13 to 16 are graphs of position across strip width against position along strip length illustrating the results of various tests carried out on coiled strips; and FIG. 17 is a graph to illustrate the variation of applied coiling stress as the coiling proceeds;

FIG. 17*a* is a front view of a mandrel on a spool in accordance with the present invention;

FIG. 17*b* is a front view of the mandrel of FIG. 17*a* with the spool removed therefrom;

FIG. 18 is a front view of a sleeve and a spool in accordance with the present invention;

FIG. 19 is a front view of a spool having a strip forming a crown wound thereon;

FIG. 20 is a perspective view of a strip of a material wound on a spool in accordance with the present invention;

FIG. 21 is a top view of spool with the strip of a material with a narrower sheet of material for attachment to the strip material; and FIG. 22 is an end view of a mandrel, a tensioning roll, and spool having a strip wound thereon in accordance with the present invention.

DETAILED DESCRIPTION OF THE PREFERRED EMOBODIMENTS

Figure 2:
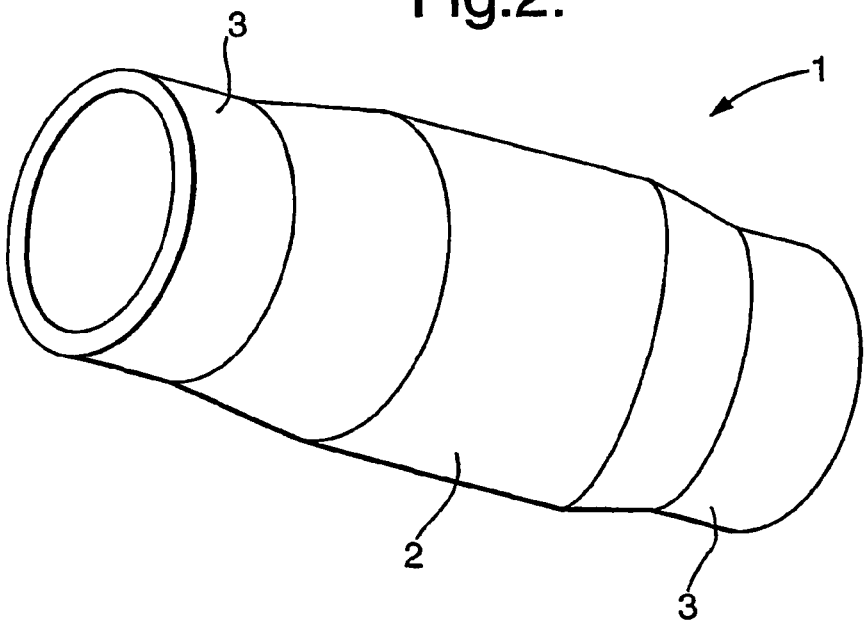
FIG. 2 is a schematic perspective view of a spool in accordance with the present invention.

A spool 1 for use in the storage and transportation of aluminium strip material is shown in FIG. 2. The spool 1 is approximately cylindrical but has a central crown region 2 where the outer diameter of the spool is greater than at the edge regions 3. The length of the spool is such as to fully support the strip material, which means in practice that the spool is at least as long as the width of the strip, and may indeed be longer; however, under certain circumstances, the spool may be very slightly shorter—perhaps by up to about 50 mm—than the width of the strip to meet certain specialist requirements. The outer diameter of the spool increases continuously to a plateau of uniform diameter from the edge regions 3 to the centre region 2. The difference between the diameter of the end and centre regions can be as great as 10 mm or more. For some applications the edge regions 3 can be cut away to leave only a narrow spool supporting just the centre of the coil. Such a narrow spool or a spool having a very high crown region 2 could mark the inner laps of the coil. The preferred difference in height between the edge regions 2 and the crown 3 is 0.02 to 1.0 mm, preferably 0.05-0.3 mm still more preferably 0.05 to 0.10 mm.

Figure 2A:
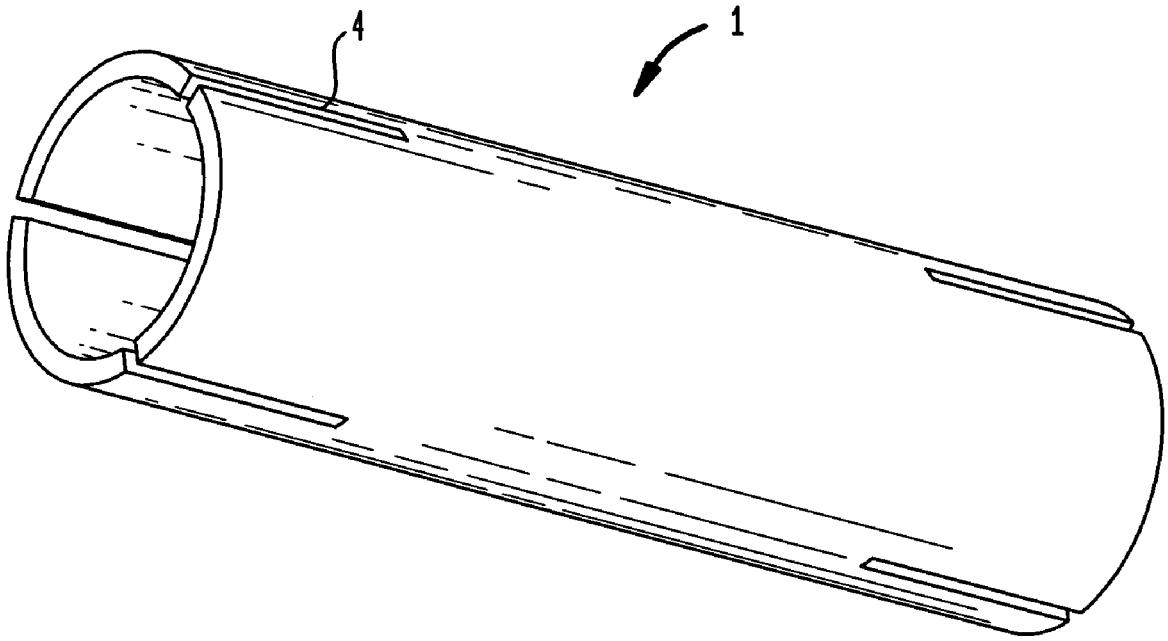

As show in FIG. 2A, the spool 1 may have slits 4 extending from each end, for example, one-quarter of the entire length of the spool. The spool may also have a substantially uniform diameter.

The shape of the spool 1 may alternatively match the profile shown in FIG. 3 which is a model prediction of the radial displacement of an outer lap on a right cylindrical spool after removal of the mandrel. As can be seen, the maximum displacement of the strip, in this case, 0.07 mm, is at the centre of the strip and the displacement rapidly decreases to zero from the maximum over a central region approximately 800 mm wide. However, the maximum displacement will depend on the height of the crown on the strip and the number of laps in the coil. Where the spool 1 has the shape shown in FIG. 3 the distribution of hoop stress while coiling the inner laps of the aluminium strip would be similar to the distribution of hoop stress for the outer laps. The hoop stress is a measure of the tension force, acting in the circumferential direction of the coiled strip, per unit cross section area of strip.

The effect of coiling an aluminium strip on a spool 1 modified in accordance with the invention is illustrated with reference to FIGS. 4 to 6. In FIG. 4 the distribution is shown of hoop stress across the width of three laps during coiling on a conventional right cylindrical spool. As can be seen the coiling tension is carried by in excess of the middle 800 mm of strip width whilst the innermost position is being coiled but this is reduced to only 600 mm when coiling the third position. This effect saturates after approximately 50 mm build-up of coil. After the mandrel is removed from the spool the reversal of the stress extends over the middle 500 mm of strip width and leaves quarter pockets of residual tension in the strip either side of the large compressive stress, at the inner position.

In FIG. 5 a similar distribution of hoop stress is shown for an aluminium strip being coiled on a spool having the shape described above with reference to FIG. 3. Here it can be seen that the coiling tension is carried by the middle 500 mm of the strip width throughout coiling and no tension pockets will be formed in the inner position after the mandrel is removed from the spool. Thus, using a spool shape that is convex with a crown across its centre region, a strip with improved flatness can be achieved. Even a small variation in the outer diameter of the spool at its central region can produce a dramatic effect to the coil stress.

Although it may be difficult to construct a spool having the shape described in FIG. 3, shapes capable of achieving similar improvements in sheet flatness can be easily constructed. For example, an approximately cylindrical deformable spool may be used in conjunction with a mandrel that varies in diameter between the centre of the spool and the spool edges. If the mandrel has a positive crown the spool deforms to a similar crown. Ideally, the mandrel is constructed so that the spool is not in contact with the mandrel either side of the central crown region.

However, the preferred spool structure utilises a length of strip to create a raised crown for the centre region of a plain cylindrical spool. For example, a conventional cylindrical spool, having uniform diameter, is converted by means of a short length of metallic (e.g. aluminium) strip having a gauge of approximately 0.28 mm gauge and a width of around 525 mm which is wound with one or more turns around the centre region 2 of the spool to form a sleeve about the centre region of the spool. The aluminium strip to be coiled is then wound around the outside of the converted spool in the usual manner. It will, of course, be appreciated that the sleeve need not be made from a metallic material and may instead be of natural fibre, plastic or other durable material. Also, as the sleeve is a separate part of the spool it can easily be constructed to the desired gauge and width. FIG. 6 shows the distribution of hoop stress for the same three positions using the converted spool described above and as can be seen the effect of using the converted spool is similar to that of FIG. 5. In particular quarter pockets on the inner laps of the strip are avoided. FIG. 6 was produced on the basis of a spool having a rectangular crown 460 mm wide. The rectangular crown concentrates the hoop stress of the inner laps, for example after 5 mm build-up, into the same width as the stress in the subsequent laps is concentrated by the coil crown. Thus, the effect of the increased spool diameter in the central portion of the strip is to reduce the width-wise range of hoop stress in the inner laps after the mandrel has been removed. This can be seen by comparing the hoop stress curves for the first position in FIG. 4 with the corresponding curve in FIG. 6. The difference comes about because the region of increased diameter supports the central part of the coil, leaving the outer regions unsupported and thus with low absolute hoop stress.

In a further alternative embodiment, illustrated in FIG. 7, a conventional plain cylindrical spool (not shown) may be used for coiling an aluminium strip 10. In order to provide the crown at the centre region of the spool, the leading end of the strip is shaped to form a tongue 11 having a width less than that of the strip 10. With the leading edge 12 of the tongue 11 centred on the spool, the first one or more laps of the strip build up to form a crown at the centre region of the spool. Thereafter, the strip 10 becomes full width and coiling of the strip continues in the usual manner. In this way the leading end of the strip itself is used to create the convex surface of the spool to ensure that the tensile stress is applied to the centre region of the innermost laps of the strip at its full width. FIG. 7 shows three possible shapes for tongue 11. In FIG. 7A, the tongue is rectangular in shape, with a substantial step change to full width (although in practice corners would preferably be rounded to reduce stress). In FIGS. 7B and 7C, a gradual transition from the leading edge 12 to full width is used, thus reducing the likelihood of snatching of the exposed corners as the strip passes through the processing machinery. Although concave curves are shown in FIGS. 7B and 7C, straight sides could also be used, the best shape for the circumstances being determined by experiment.

The length l of the tongue should be at least equal to a single turn around the circumference of the spool; however, if this does not give sufficient thickness a longer tongue can be used, preferably of length equal to a multiple of the circumferential length of the spool, since other than a multiple would lead to unbalanced forces during coiling.

In a still further alternative, illustrated in FIG. 8, a conventional plain cylindrical spool (not shown) is used, and the strip 10 adapted by attaching to one face, at the leading end, a sheet 13 of thin material. This material may, for example, be aluminium which is attached by adhesive. It will be seen that, as the strip 10 is coiled around the spool, the thickness of sheet 13 acts to increase the effective diameter of the spool in the central section of the width of the strip 10, thus giving the same effect as described above. One or more further sheets (not shown) may be attached on top of sheet 13 to increase the thickness, as required, and these extra sheets may be attached to the opposite surface of strip 10. The "extra" sheet or sheets thus applied need not necessarily be the same size as sheet 13, but could be smaller to provide a stepped edge or edges to sheet 13.

The length of sheet 13 in the longitudinal direction of the strip 10 will be at least equal to the circumferential length of the spool and possibly a multiple thereof, as discussed above with reference to the tongue 11 of FIG. 7.

In FIG. 9 the creep strain across the width of the first position 24 hours after coiling is illustrated for a conventional right cylindrical spool, a spool having a convex (positive) crown, and a spool having edge sleeves. In FIG. 9, creep strain is given in i-units which are defined as $$\epsilon_r \cdot 10^5$$

where $\epsilon_r$ is the relative strain, given by:

$$\epsilon_r = \Delta L / L_a$$

where $\Delta L$=change in length $L_a$=average of original lengths of all positions across the width of the strip As can be seen in FIG. 9, for the conventional spool the strain extends over the middle 800 mm of the strip width so that the strip at the innermost superlap is likely to exhibit wavy edge off-flatness. For a strip coiled on a convex spool the strain extends over only the middle 500 mm of width and will exhibit less wavy edge off flatness. The spool with the edge sleeves produces massive differences in strain between the centre and the edge and consequently a large off flatness. This latter corresponds approximately to the prior art spool of JP 11 17 94 22.

Figure 1:
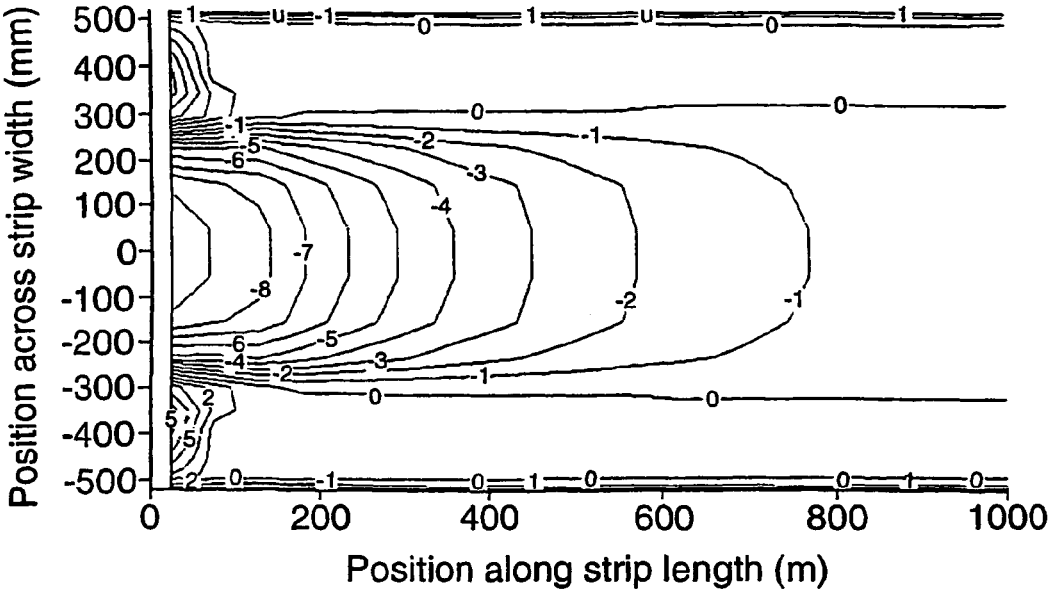
FIG. 1 illustrates a model prediction of the creep strain for an aluminium strip coiled on a conventional spool.

In FIG. 10 the flatness change over the entire length of the aluminium strip in terms of creep strain (in i units) is illustrated and may be compared with FIG. 1 for a conventional spool. Most notably, for the inner laps the positive strain towards the edges of the strip in FIG. 1 is missing from FIG. 10. Also the magnitude of any wavy edge effects is greatly reduced in FIG. 10. FIG. 10 thus illustrates that the off-flatness effects likely to be found using conventional coiling methods can be avoided or at least reduced using the contoured spool and the coiling method described above.

The positive contours of the spool may also be achieved by weakening the axial ends of the spool. For example, slits may be cut into the ends of the spool up to a distance of approximately ¼ the width of the spool which would cause the ends to collapse under the compressive load of the coil (for example when the ends are not supported by the mandrel or when the support from the mandrel is withdrawn) to form a central convex crown. Here too the beneficial shape is adopted by the spool only after a few laps of the aluminium strip. In a further alternative, the central region of the spool may be constructed of a different material to that of the edge regions with the material of the central region being more rigid so that as the strip material is coiled onto the spool the edge regions produce a greater deflection in response to the compressive load of the laps than the central region.

The above description has focused on utilising a convex spool to reduce the off-flatness effects of a coiled aluminium strip. It is also possible to control off-flatness effects through controlling and adjusting the tension of the strip as it is being coiled. To reduce off-flatness effects the tension applied to the strip must be higher, for example up to 30 MPa, for the initial laps of the coil and then be reduced to a lower tension for the outer laps of the coil. This reduction in tension can extend over up to half the entire length of the strip. However, it is preferable if the reduction in tension is limited to the first third of the entire strip length.

The earlier model predictions for a convex spool were all generated assuming that the maximum coiling tension for the initial laps was about twice that of the outer laps the reduction being effected over about the first 25 mm of build up of the coil (referred to as the conventional practice). In FIGS. 11 and 12 the effect of coiling tension on the flatness of aluminium strip coiled onto a convex spool is illustrated. In FIG. 11 creep strain along the centre line of the strip, immediately after coiling, is plotted for an aluminium strip coiled onto a conventional plain spool using conventional practice; onto a convex spool using conventional practice; onto a convex spool using an initial coiling tension of 10 MPa; and onto a convex spool using an initial coiling tension of 15 MPa. In the last two cases, the coiling tension was decreased exponentially to about half the original value during the first 15 mm build up of the coil. As the coil continues to build up, it can be advantageous to decrease the tension still further to a level that does not cause significant creep to occur e.g. to around 10 to 50% of the starting tension. It can be clearly seen from FIG. 11 that the use of a convex spool in combination with a much higher initial coiling tension greatly increases the creep strain in the strip for the inner laps of the coil and indeed that the larger the initial tension, the larger the long middle strain in the inner laps during coiling. In FIG. 12, which provides the same examples for comparison but for creep strain 24 hours after coiling, it can be seen that the larger the initial coiling tension the smaller the compressive strain in the inner laps after 24 hours. From FIG. 12 for an initial coiling tension of 15 MPa, the strip is flat for the laps very close to the spool and then a wavy edge builds up at around 25 mm.

Whilst details are given of different structures of spools and different methods of adjusting coil tension for enabling the stress in the inner laps to be adjusted, these are only examples and the spirit and scope of the present invention is not restricted to the particular examples given above.

EXAMPLE

AA1050 sheet cold rolled to a thickness of 0.28 mm and width of 1050 mm with a positive crown profile was wound into coils 1750 mm in diameter using the conventional practice. Four coils were made one on each of the following spools:

1) Cylindrical spool (comparative example)
2) Cylindrical spool as in (1) but with eight equally spaced slits in each end of the spool extending to the edge of the central 500 mm region.
3) As in (1) but with a single lap of 0.15 mm thick 500 mm wide aluminium strip wound round the centre of the spool
4) As in (3) but with a strip 0.3 mm thick 24 hours after coiling the coils were unwound and flatness samples 4 m long were taken at intervals along the entire length of the sheet. Samples were taken closer together towards the spool end of the coil than at the start. Flatness was measured by placing the samples on a flat steel table and measuring the levels of any off-flatness, represented as strain in i-units, by means of displacement transducers. The results are plotted in FIGS. 13 to 16 respectively showing contours of levels of off-flatness for various positions in the coil. The same contour steps, of 0.25 i-units, have been used for all graphs. From the figures it will be seen that the crowned spools reduced the level of off-flatness by a factor of about 2.5. This is a significant improvement.

The invention claimed is:

1. A system for coiling of aluminum strip material having a coil assembly comprising a mandrel, a spool removably mounted on the mandrel and an aluminum strip material having a positive crown, the coil assembly having a supporting surface for coiling the strip material, the supporting surface providing a support profile in which that part of the supporting surface which supports the crown has a greater diameter than remaining parts of the supporting surface during coiling of inner laps of the strip material, wherein the spool has a length at least equal to the width of the strip material.

2. a system as claimed in claim 1, wherein the support profile of the supporting surface is provided by adaptation of the spool.

3. A system as claimed in claim 2 wherein the spool is cylindrical, of substantially uniform diameter, and has slits extending from one or both ends of the spool.

4. A system as claimed in claim 3, wherein the slits extend approximately one quarter of the length of the spool.

5. A system as claimed in claim 2, wherein the spool has an outer diameter at that part of the spool which supports the crown that is greater than the outer diameter of the spool at one or both opposing end regions of the spool.

6. A system as claimed in claim 5, wherein the spool is contoured to have an outwardly projecting crown over said part of the spool.

7. A system as claimed in claim 6, wherein the outwardly projecting crown is rectangular.

8. A system as claimed in claim 2, wherein that part of the spool which supports the crown is formed of a material having greater rigidity than that of a material forming one or both of the opposing end regions of the spool.

9. A system as claimed in claim 1, further including at least one tensioning roll and a tension control device to control tension of the strip material as it is coiled from a first higher tension to a second lower tension.

10. A system as claimed in claim 1, wherein the support profile of the supporting surface is provided by means separate from the spool.

11. A system as claimed in claim 10, wherein the spool is cylindrical in shape.

12. A system as claimed in claim 11, wherein the means separate from the spool that provides a support profile of the supporting surface is an outer sleeve mounted about that part of the spool which supports the crown, the outer sleeve having a width less than the width of the strip material.

13. A system as claimed in claim 11, wherein the means separate from the spool is a length of material which is wound one or more times around the spool prior to coiling, the length of material having a width narrower than that of the strip material.

14. A system as claimed in claim 10, wherein the means separate from the spool that provides the support profile of the supporting surface is the strip material shaped to have, when wound, the greater diameter at the part that supports the crown.

15. A system as claimed in claim 14, wherein a leading end of the strip material is formed as a tongue having a width narrower than the width of the strip material.

16. A system as claimed in claim 15, wherein the length of the tongue, in the longitudinal direction of strip material, Is approximately equal to n times the outer circumference of the spool, wherein n is an integer greater than zero.

17. A system as claimed in claim 10, wherein the means separate from the spool is a sheet of material is attached to a surface of a leading end of the strip material, the sheet having a width narrower than that of the strip material.

18. A system as claimed in claim 17, wherein the sheet of material has a length, in the longitudinal direction of the strip material, which is approximately equal to n times the outer circumference of the spool, where n is an integer greater than zero.

19. A system as claimed In claim 18, wherein the sheet is made of aluminum.

* * * * *